US012049827B2

(12) United States Patent
Kroczek et al.

(10) Patent No.: US 12,049,827 B2
(45) Date of Patent: Jul. 30, 2024

(54) VANE WEARING DETECTION

(71) Applicant: Goodrich Corporation, Charlotte, NC (US)

(72) Inventors: Piotr Kroczek, Nieciszów (PL); Filip Sobolewski, Wieluń (PL); Piotr Zając, Wrocław (PL); Tomasz Wanski, Chrzastawa Wielka (PL); Wojciech Mandziuk, Majdan Górny (PL)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 18/185,529

(22) Filed: Mar. 17, 2023

(65) Prior Publication Data

US 2023/0313683 A1 Oct. 5, 2023

(30) Foreign Application Priority Data

Mar. 31, 2022 (EP) ..... 22461532

(51) Int. Cl.
*F01C 21/08* (2006.01)
*F01C 1/344* (2006.01)

(52) U.S. Cl.
CPC ..... *F01C 21/0809* (2013.01); *F01C 1/344* (2013.01); *F01C 21/0863* (2013.01); *F04C 2270/16* (2013.01)

(58) Field of Classification Search
CPC .. F01C 21/0809; F01C 1/344; F01C 21/0863; F04C 2270/16
See application file for complete search history.

(56) References Cited

U.S. PATENT DOCUMENTS 3,463,384 A 8/1969 Kilbane
3,469,500 A * 9/1969 Lutz ..... F01C 21/0809 418/2
3,869,231 A 3/1975 Adams
(Continued)

FOREIGN PATENT DOCUMENTS

DE 3303906 A1 8/1984
FR 2596107 A1 9/1987
WO 2014010677 A1 1/2014

OTHER PUBLICATIONS

Abstract for FR2596107 (A1), Published: Sep. 25, 1987, 1 page.
(Continued)

*Primary Examiner* — Mary Davis
(74) *Attorney, Agent, or Firm* — CANTOR COLBURN LLP

(57) ABSTRACT

A vane for use in a rotary vane pump. The vane has a length L extending between a first edge of the vane and a second edge of the vane and a width W extending perpendicular to said length, the width extending between a third edge of said vane and a fourth edge of the vane, and further comprising a channel extending through said vane and provided at a position along said length L of said vane. The channel maybe positioned away from said first and second edges such that said vane has a constant length L along its width. The width of the channel may vary in shape between first and second points along the length of the vane. The channel may have a triangular shape, a rectangular shape or a circular shape. A method for detecting the decrease in length of the vane is also described.

9 Claims, 4 Drawing Sheets

(56) References Cited

U.S. PATENT DOCUMENTS

| | | | |
|---|---|---|---|
| 3,904,327 | A | 9/1975 | Edwards et al. |
| 4,705,465 | A | 11/1987 | Su |
| 6,752,604 | B2 | 6/2004 | Althouse |
| 6,769,886 | B2 | 8/2004 | Henderson |
| 6,913,451 | B2 | 7/2005 | Hedrick et al. |
| 9,828,992 | B2 | 11/2017 | Stambaugh, Sr. |
| 2002/0110467 | A1 | 8/2002 | Henderson |

OTHER PUBLICATIONS

Abstract: DE3303906 (A1), Published: Aug. 6, 1984, 1 page.
European Search Report for Application No. 22461532.8, mailed Sep. 29, 2022, 8 pages.

* cited by examiner

SECTION A-A

SECTION B-B

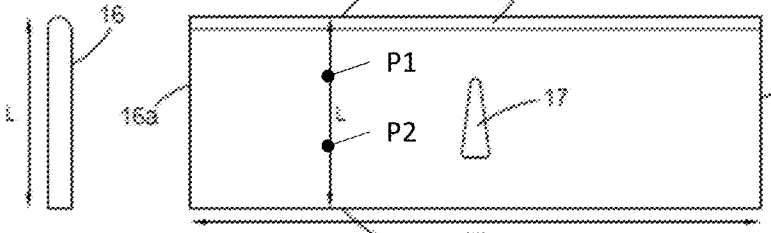
FIG. 5
FIG. 6
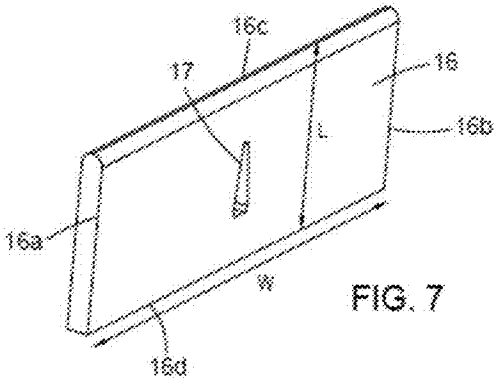
FIG. 7

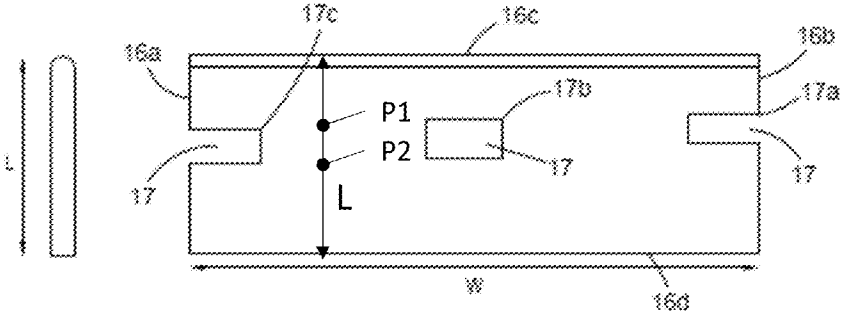
FIG. 8
FIG. 9
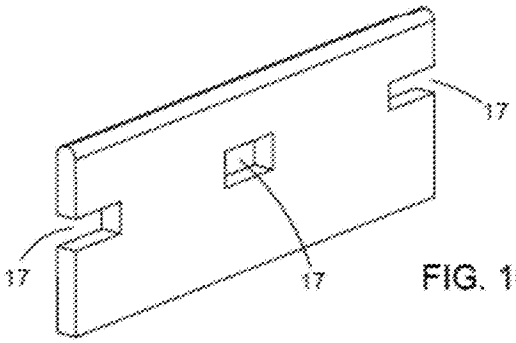
FIG. 10

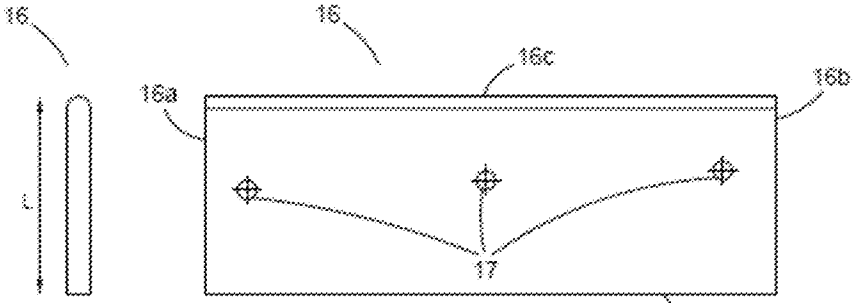
FIG. 11
FIG. 12
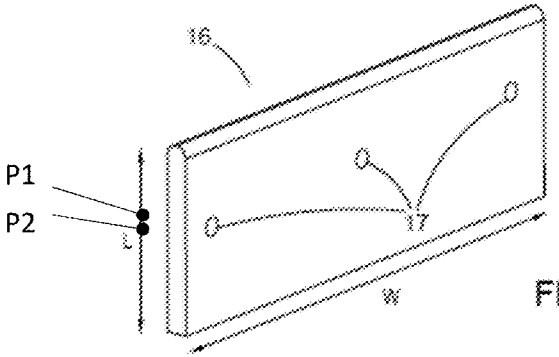
FIG. 13

VANE WEARING DETECTION

CROSS-REFERENCE TO RELATED APPLICATIONS

This application claims priority to European Patent Application No. 22461532.8 filed Mar. 31, 2022, the entire contents of which is incorporated herein by reference.

TECHNICAL FIELD

The methods and systems described herein relate to rotary vane pumps and in particular, methods and systems for assessing wear of a vane of such pumps.

BACKGROUND

Sliding rotary vane pumps may be used in a plurality of different mechanical and industrial applications (e.g. they may be used in both liquid and gas pumping applications) and can be invariable exposed to a wide range of environmental conditions. One type of rotary vane pump is a dry air pumps, which are dry vacuum pumps constructed of carbon vanes and rotors which are self-lubricating. Such dry air pumps may comprise mechanical carbon rots and vanes that operate in a hardened metal cavity. Such pumps may provide a power source in a multitude of applications such as to provide power to pneumatically operated flight instruments, for example.

Although such dry air pumps do not use a liquid lubricant, they do use other lubricating methods such as self-lubricating coatings, amongst other methods. Although such lubricating methods may work well to some extent, the nature of the vane lubrication technique is still destructive to the parts of the pump. Due to this, parts of the pump, such as the vanes, can wear down over time. This results in the lengths of the vanes eventually being too short to fit into the slot in which it is positioned in use and this can result in failure of the pump. If the pump is used in an aircraft, such failure can result in one or more of the aircraft systems becoming inoperative and, since this would most often occur during use, i.e. in flight, this can be quite dangerous. It is therefore important to ensure that any wearing, or the extent of wearing of the vane can be clearly and accurately detected so that such failures do not occur.

Some known techniques, such as those discussed in U.S. Pat. No. 6,769,886 B2 assess the length of a vane using an external tool which is inserted into the pump via a designated channel. The tool is then used to measure the height of the vane. This measurement is only possible after the pump has been disassembled from the airplane and the measurement of the length vane is not precise.

SUMMARY

A vane for use in a rotary vane pump is described herein, said vane having a length L extending between a first edge of the vane 16 and a second edge of the vane and a width W extending perpendicular to said length, said width extending between a third edge of said vane and a fourth edge of the vane, and further comprising a channel extending through said vane (16) and provided at a position along said length L of said vane.

In any of the examples described herein, the channel may be positioned away from said first and second edges such that said vane has a constant length L along its width.

In any of the examples described herein, said channel may extend between a first point along said length and a second point along said length and wherein a width of said channel varies in shape between said first and second points.

In any of the examples described herein, the width of said channel may taper from a first channel width to a second channel width, wherein said first channel width is smaller than said second channel width. The first point may be closer to said first edge and said second point is closer to said second edge, or vice versa.

In any of the examples described herein, said channel may have a triangular shape, a rectangular shape or a circular shape.

In any of the examples described herein, the vane may comprise a plurality of said channels.

In any of the examples described herein, a first of one of said plurality of channels may be offset from a second one of said plurality of channels along said length of said vane. That is, the first one of said plurality of channels may be provided at a first position along the length of the vane and a second of said plurality of channels may be provided at a second position along the length of said vane, and wherein said first position and said section are not the same as each other, such that said first channel is closer to said first edge than said second channel.

In any of the examples described herein, said plurality of channels may be offset from each other in along said width of said vane.

A rotary vane pump is also described that comprises the vanes described herein. The pump may comprise a rotor "R" configured to rotate about a central axis; said rotor comprising a plurality of circumferentially spaced vane slots, wherein at least one of said vane slots is configured to receive one of the vanes described herein.

The vane may be inserted into the slot of the rotor R such that the second edge of the vane is positioned closer to the central axis of the rotor R than the first edge of the vane 16.

A method for detecting a decrease in the length of a vane (i.e. wear of the vane 16) provided in a rotary vane pump is also described herein. The method comprises providing a rotor "R" configured to rotate about a central axis; said rotor comprising a plurality of circumferentially spaced vane slots, wherein at least one of said vane slots is configured to receive a vane, inserting said vane into said at least one vane slot, said vane having a length L extending between a first edge of the vane and a second edge of the vane and a width W extending perpendicular to said length, said width extending between a third edge of said vane and a fourth edge of the vane, and said vane further comprising a channel extending through said vane and provided at a position along said length L of said vane, said method comprising measuring a pressure in said rotary vane pump, and detecting a decrease in said pressure of said rotary vane pump, said decrease in pressure indicating that said vane has decreased to a length corresponding to said channel.

The method may be used in combination with any of the vanes described herein.

BRIEF DESCRIPTION OF THE DRAWINGS

FIG. 5 depicts an end view of a vane that may be used in a rotary pump.

FIG. 6 depicts a front view of a vane that may be used in a rotary pump wherein the vane has a triangular shaped channel extending therethrough.

FIG. 7 depicts a perspective view of the vane of FIG. 6.

FIG. 8 depicts an end view of a vane that may be used in a rotary pump.

FIG. 9 depicts a front view of a vane that may be used in a rotary pump wherein the vane has a plurality of rectangular shaped channels extending therethrough.

FIG. 10 depicts a perspective view of the vane of FIG. 9.

FIG. 11 depicts an end view of a vane that may be used in a rotary pump.

FIG. 12 depicts a front view of a vane that may be used in a rotary pump wherein the vane has circular shaped channels extending therethrough.

FIG. 13 depicts a perspective view of the vane of FIG. 12.

DETAILED DESCRIPTION

Figure 2:
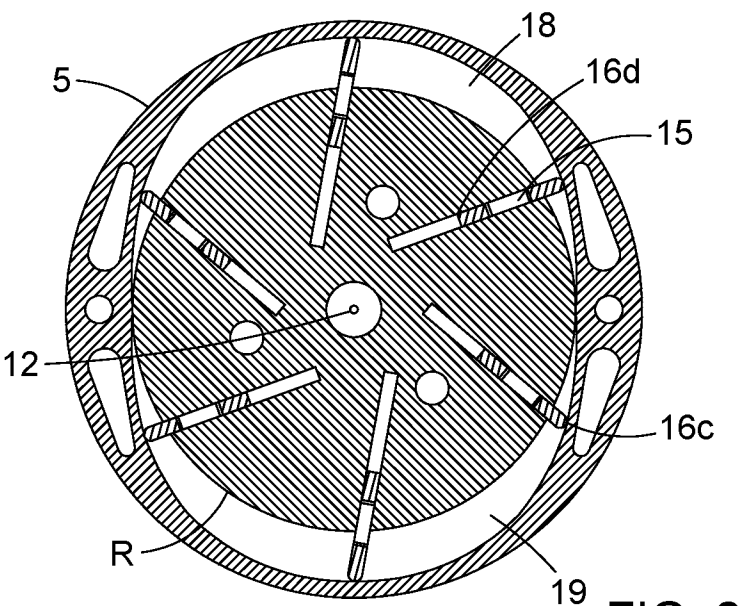
FIG. 2 depicts a cross-sectional view of the rotary pump taken along the line A-A of FIG. 1.
Figure 4:
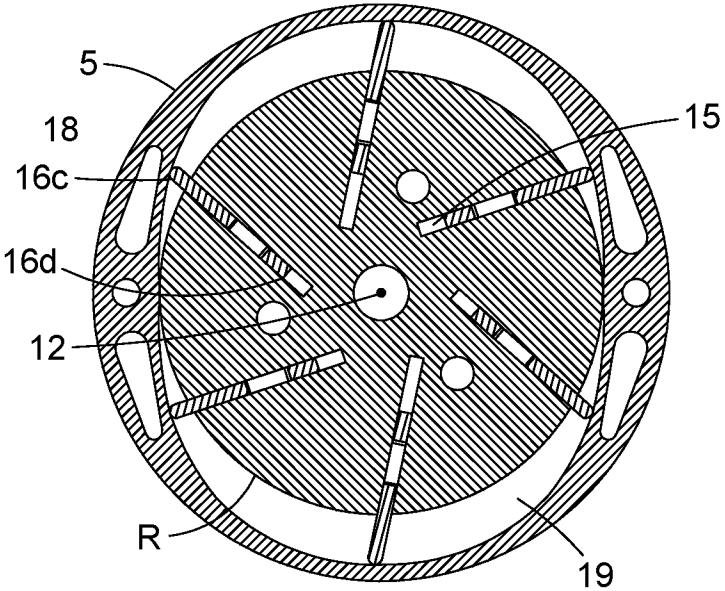
FIG. 4 depicts a cross-sectional view of the rotary pump taken along the line B-B of FIG. 3.

A rotary vane pump comprises a central annular body of stator, S, a cross-section of which is shown in FIGS. 2 and 4. The pump comprises a rotor R that provides a bearing surface for rotary movement of rotor R about its central axis 12. In the example shown in FIGS. 2 and 4, the rotor R is provided with six circumferentially spaced vane slots 15 that are angled slightly from a radial direction and which extend over the entire longitudinal length of rotor R. Although each rotor R is depicted here with six slots 15, the examples described herein are not limited to this and another number of slots 15 may also be used. Each slot 15 is configured to receive, and receives, a vane 16 that slides in and out of slot 15 as rotor R is rotationally driven about its center axis 12.

Each vane 16 is made from a material that during use, wears and produces a form of dry lubrication for the pump when in use. For example, vanes 16 can be made from carbon material, graphite, and various organic binders. In some examples, a self-lubricating coating may be applied to the pump parts to inhibit wear between the slidable vanes 16 and pump rotor R.

A stator S is provided that surrounds the rotor R. The stator S has two symmetrically opposite lobes 18 and 19, the surfaces of which act as cams that regulate the two extension and retraction cycles for the vanes 16 during each rotation of the rotor R. As is known in the art, the longitudinal spaces defined by the adjacent vanes 16 and the external surface of the rotor R, as well as the surface of a stator lobe, and end plates of the pump serve as pumping pockets which are moved from an intake zone to an exhaust zone to accomplish the pumping action of the pump R.

FIG. 5 depicts an end view of a vane 16 which may be inserted into the slots 15 of the rotor R as described above with reference to FIGS. 1 to 4. FIG. 6 depicts a front view of the vane 16 of FIG. 5 and FIG. 7 depicts a perspective view of the vane 16 of FIGS. 5 and 6.

As can be seen in FIGS. 6 and 7, the vane 16 has a length L that extends between a first edge 16*c* of the vane 16 and a second edge 16*d* of the vane end the vane has a width W that extends between a third edge 16*a* and a fourth edge 16*b* of the vane 16. In use, the vane 16 is inserted into the slot 15 of the rotor R such that the second edge 16*d* is closer to the central axis 12 of the rotor R than the first edge 16*c* of the vane 16. The length L of the vane 16 is therefore dictated by the length of the slot 15 into which it is inserted and the width W of the vane 16 is dictated by the width of the rotor R of the pump.

In known rotary pumps, the vane is solid, and as the vane wears down, the length L of the vane gets shorter and shorter until the lengths of the vanes eventually become too short to fit into the slots of the rotor. As mentioned in the background section above, this results in failure of the pump.

In the examples described herein, however, the vane 16 comprises a channel 17 which extends through the vane 16. This channel 17 may be any number of shapes, including circular, square, rectangular, triangular, to name a few. The channel 17 may also be tapered.

The channel 17 may be provided so as to extend through the vane 16 and also between a first point P1 and a second point P2 along a portion of the length L of the vane as shown in FIGS. 6 to 13. In use, the first edge 16*c* of the vane wears down, such that the length L of the vane 16 decreases. At some point, the vane 16 has worn down to such an extent that the channel 17 is reached, which creates a drop in pressure of the longitudinal space(s) defined by the adjacent vanes 16 as discussed above. If the position of the channel 17 on the length of the vane 16 is known, it is therefore possible to correlate this drop in pressure with the fact that the vane has worn down to a specific length. This provides a warning signal that the wear of the vanes is now in its early stages and should be monitored.

Whilst the channel remains in communication with the longitudinal space of the pump, this drop in pressure will remain as the vane continues to wear down. Once the vane 16 is worn down to such an extent that the channel 17 has been passed, the pressure in the longitudinal space will again increase and this provides a second warning signal that the vane 16 has worn down significantly to a length wherein the vane should be replaced.

Figure 3:
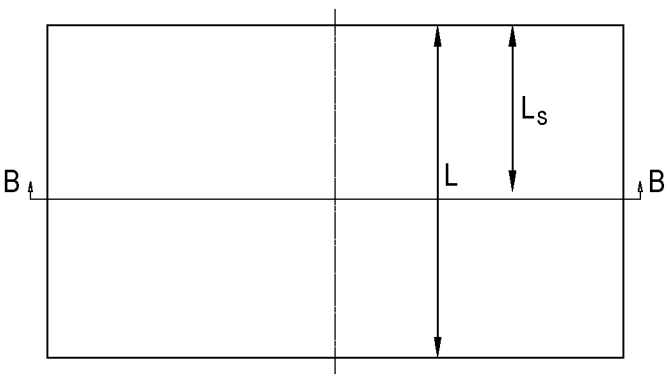
FIG. 3 depicts an external view of the outer surface of the rotary pump of FIGS. 2 and 4, depicting a second cross-sectional cut, B-B.

In the example described and shown with reference to FIGS. 2 and 3 the channel 17 is triangular shaped, such that, in use, the tip of the triangle is further from the central axis of rotation 12 than the bottom of the triangle. Due to this, once the wear of the vane 16 has reached the point wherein the length L of the vane reaches the tip of the triangle, a small drop in pressure will indicate to the user that the length of the vane has worn down to this particular point. Since the triangle has a width that increases in the direction of the central axis 12, as the length of the vane decreases further, the channel 17 will become wider and wider, and the pressure will decrease further and further. Once the length of the vane 16 has decreased to such an extent that the bottom of the triangle has been reached and the channel 17 is no longer present, the pressure will again increase and the user will know that the length of the vane 16 is sufficiently short such that the vane should be replaced.

Figure 1:
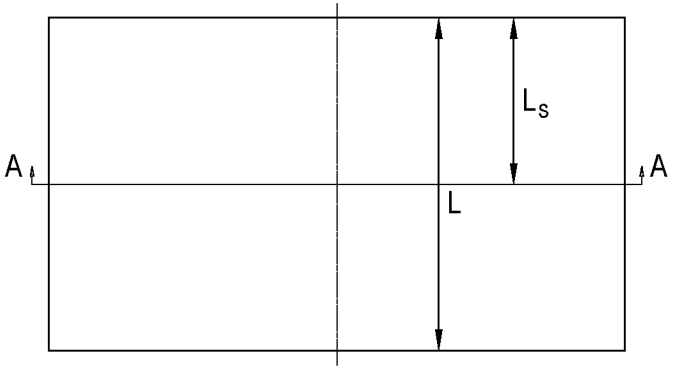
FIG. 1 depicts an external view of the outer surface of the rotary pump of FIGS. 2 and 4, depicting a first cross-sectional cut, A-A.

FIG. 2 depicts the cross-sectional view of the pump along the line A-A of FIG. 1 whereas FIG. 4 depicts the cross-sectional view of the pump along the line B-B of FIG. 3. As can be seen from these figures, in FIGS. 1 and 3, the shortened length Ls of the vane 16 corresponds to a shorter length of the vane 16 in use in comparison to the shortened length in FIG. 3. Although in this example, each of the vanes have been provided with a channel extending therethrough, in some examples wherein the vanes are expected to wear at the same rate, only one vane 16 may be provided with a channel 17 extending therethrough.

Although the channel 17 shown in FIGS. 5 and 6 relates to a triangular shape, other shapes can be used, as mentioned above, including those which do not have a width that changes over time. In such examples, the initial drop in pressure and the later increase in pressure would indicate to the user that the length of the vane 16 has reached a length where it has starting to be worn and a length where it may be critically short and the vane may have to be replaced.

The channel 17 may be positioned along the length L of the vane such that it is away from, i.e. not at, or cut into, the first or second edge. The length of the vane 16 therefore remains constant along the width of the vane and the channel 17 does not shorten the length of the vane at any point along its width. For example, the channel 17 may be positioned at a point approximately midway along the length L of the vane 16. In other examples, the channel may be positioned closer to one of the first or second edges rather than the other. In other words, the channel may not be in contact with the first edge 16*c* prior to use, or in contact with the second edge 16*d* prior to use but is positioned at a point between the first and second edges 16*c*, 16*d*, such that the drop in pressure can be detected due to wear.

In other examples, wherein the channel 17 is not triangular shaped, other shapes may be used wherein the channel 17 has a varying and/or tapered with along its length and between the end 16*c* which is being worn during use and the opposite end 16*d* which is closest to the central axis of the stator S during use. Although in the examples shown in FIGS. 5 and 6, the width of the channel 17 increases as the length L of the vane gets shorter, in other examples, the channel 17 may have a varied or tapering width, wherein the width decreases as the length of the vane gets shorter.

Another example of a new type of vane 16 is shown in FIGS. 8 to 10. As can be seen in FIGS. 9 and 10, in this example, a plurality of rectangular shaped channels 17 are provided in a position that initially lies approximately midway along the length of the vane. Of course, in other examples, only one, or two, or more such shaped channels could be provided in the vane 16. This example functions in the same manner as described above. that is, as the vane 16 wears down and the length shortens, the channel 17, or plurality channels 17 become exposed and result in a drop in pressure. The drop in pressure is maintained until the vane 16 becomes even shorter, wherein the channel 17 is no longer present, as that section of the vane has been worn away. Once the user is warned that the pressure has increased again, they are aware that the vane has shortened in length to a length that is less than the end of the channel 17 and the vane should be replaced. In the example depicted in FIGS. 11 to 13, the channel has a circular shape. Again, a plurality of channels is depicted here, however, the vane may have any number of channels in order to perform the required function.

In the example shown in FIGS. 8 to 10, the plurality of channels 17 are provided at different positions along the length of the vane 16. For example, as shown in FIGS. 9 and 10, the channel 17*a* is positioned closest to the edge 16*c* of the vane that wears during use. The second channel 17*b* is positioned along the length of the vane 16 such that it is further away from the edge 16*c* in comparison to the first channel 17*a*. The third channel 17*c* is positioned along the length of the vane 16 such that it is the furthest away from the edge 16*c* which wears during use. Due to this, when the edge 16*c* wears in use, the first channel 17*a* will become exposed and there will be a resulting drop in pressure in the pump. The user will then be warned that the length of the vane has been shortened to this extent. As the vane wears further, the second channel 17*b* will then become exposed and the pressure will drop again. The same will occur when the third channel 17*c* is reached. Due to this, the user can detect the extent to which the vane has shortened in length based on the pressure readings taken from the pump.

Another example of this is shown in FIGS. 11 to 13. In this example, the same concept is used as in FIGS. 8 to 10, however in this example the channels 17 are formed to be circular. Again, they are provided at different positions along the length of the vane such that as each channel 17 is reached, the change in pressure of the pump will indicate to the user the length to which the vane has shortened.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

The invention claimed is:

1. A vane for use in a rotary vane pump, the vane comprising:

a first, second, third and fourth edges;

wherein the vane defines a length L extending between the first edge of the vane and the second edge of the vane and a width W extending perpendicular to said length, said width extending between the third edge of said vane and the fourth edge of the vane; and a channel extending through said vane and provided at a position along said length L of said vane, wherein said channel extends between a first point along said length and a second point along said length and wherein a width of said channel varies in shape between said first and second points, and wherein said channel is positioned away from said first and second edges such that said vane has a constant length L along its width;

wherein the vane includes a plurality of said channels;

wherein said plurality of channels are offset from each other in along said width of said vane.

2. The vane of claim 1, wherein said width of said channel tapers from a first channel width to a second channel width, wherein said first channel width is smaller than said second channel width.

3. The vane of claim 1, wherein said first point is closer to said first edge and said second point is closer to said second edge.

4. The vane of claim 1, wherein said channel has a triangular shape or a circular shape.

5. A rotary vane pump comprising:

a vane of claim 1;

a rotor "R" configured to rotate about a central axis; said rotor comprising a plurality of circumferentially spaced vane slots, wherein at least one of said vane slots is configured to receive the vane.

6. The rotary vane pump of claim 5, wherein said vane is inserted into the slot of the rotor R such that the second edge of the vane is positioned closer to the central axis of the rotor R than the first edge of the vane.

7. A vane for use in a rotary vane pump, the vane comprising:

a first, second, third and fourth edges;

wherein the vane defines a length L extending between the first edge of the vane and the second edge of the vane and a width W extending perpendicular to said length, said width extending between the third edge of said vane and the fourth edge of the vane; and a channel extending through said vane and provided at a position along said length L of said vane, wherein said channel extends between a first point along said length and a second point along said length and wherein a width of said channel varies in shape between said first and second points, and wherein said channel is positioned away from said first and second edges such that said vane has a constant length L along its width;

wherein the vane includes a plurality of said channels;

wherein a first of one of said plurality of channels is offset from a second one of said plurality of channels along said length of said vane, by said first one of said plurality of channels being provided at a first position along the length of the vane and the second one of said plurality of channels being provided at a second position along the length of said vane, and wherein said first position and said second position are not the same as each other, such that said first of one of said plurality of channels is closer to said first edge than said second of one of said plurality of channels.

8. A rotary vane pump comprising:

a vane of claim 7;

a rotor "R" configured to rotate about a central axis; said rotor comprising a plurality of circumferentially spaced vane slots, wherein at least one of said vane slots is configured to receive the vane.

9. A method for detecting decrease in the length of a vane provided in a rotary vane pump, said method comprising:

providing a rotor "R" configured to rotate about a central axis; said rotor comprising a plurality of circumferentially spaced vane slots, wherein at least one of said vane slots is configured to receive the vane;

inserting said vane into said at least one vane slot, said vane having a length L extending between a first edge of the vane and a second edge of the vane and a width W extending perpendicular to said length, said width extending between a third edge of said vane and a fourth edge of the vane, and said vane further comprising a channel extending through said vane and provided at a position along said length L of said vane, wherein said channel extends between a first point along said length and a second point along said length and wherein a width of said channel varies in shape between said first and second points; and measuring a pressure in said rotary vane pump, and detecting a decrease in said pressure of said rotary vane pump, said decrease in pressure indicating that said vane has decreased to a length corresponding to said channel;

wherein the vane includes a plurality of said channels, wherein a first of one of said plurality of channels is offset from a second one of said plurality of channels along said length of said vane, or wherein said plurality of channels are offset from each other along said width of said vane.

* * * * *